US008671484B1

(12) United States Patent
Logiodice

(10) Patent No.: US 8,671,484 B1
(45) Date of Patent: Mar. 18, 2014

(54) CONTOURED SUPPORT DEVICE FOR POSING INFANTS

(76) Inventor: Amanda Rachael Logiodice, Pittsfield, ME (US)

( * ) Notice: Subject to any disclaimer, the term of this patent is extended or adjusted under 35 U.S.C. 154(b) by 0 days.

(21) Appl. No.: 13/363,559

(22) Filed: Feb. 1, 2012

Related U.S. Application Data

(60) Provisional application No. 61/439,921, filed on Feb. 6, 2011.

(51) Int. Cl.
*A47D 13/00* (2006.01)

(52) U.S. Cl.
USPC ..... 5/655; 5/702; 5/655.4; 5/911

(58) Field of Classification Search
CPC ..... A47C 27/086; A47D 13/00
USPC ..... 5/603, 632, 636, 644, 702, 731, 655, 5/655.4, 911, 948; 297/284.1, 452.17; D6/601
See application file for complete search history.

(56) References Cited

U.S. PATENT DOCUMENTS

| | | | | |
|---|---|---|---|---|
| 2,281,629 | A * | 5/1942 | Snow | 5/655 |
| 3,899,210 | A | 8/1975 | Samhammer | |
| 4,027,888 | A * | 6/1977 | Wilcox | 297/452.17 |
| 4,748,702 | A | 6/1988 | Sandler | |
| 4,832,007 | A | 5/1989 | Davis, Jr. | |
| 4,924,540 | A | 5/1990 | Main | |
| 5,226,384 | A * | 7/1993 | Jordan | 119/28.5 |
| 5,771,514 | A | 6/1998 | Wilhoit | |
| D402,150 | S | 12/1998 | Wurmbrand | |
| 6,254,189 | B1 * | 7/2001 | Closson | 297/397 |
| 6,345,401 | B1 | 2/2002 | Frydman | |
| 7,210,178 | B2 | 5/2007 | DiGirolamo | |
| 8,341,782 | B2 * | 1/2013 | Abrahams | 5/655 |
| 2006/0096031 | A1 | 5/2006 | Foster | |
| 2011/0094033 | A1 | 4/2011 | Lee | |
| 2011/0131728 | A1 | 6/2011 | Rose et al. | |

OTHER PUBLICATIONS

Walmart.com Carpenter Co. Perfect Luxury Contour Sleeping Memory, 1 page, Nov. 28, 2011.
Walmart.com Eclipse Perfection Rest Eclipse Contour Memory Foam, 1 page, Nov. 28, 2011.
Walmart.com Carex Memory Foam Contour Cervical Pillow, 1 page, Nov. 28, 2011.
Dinnel, Space Memory Cotton B-Shaped Pillow, 3 pages, Nov. 28, 2011.
Dinnel, Natural Latex B-Shaped Pillow, 3 pages, Nov. 28, 2011.

* cited by examiner

*Primary Examiner* — Nicholas Polito

(57) ABSTRACT

The invention is a support device for posing an infant for a photograph. The support device has a fabric case with a filling that provides a comfortable support for the infant, yet does not compress under the weight of the infant. The upper surface of the support device has a curved contour that includes a two bolsters or convex curved raised edges that are parallel to each other, with a valley between the bolsters. A newborn may be nestled in the valley or placed in various poses on the first or second bolster.

3 Claims, 11 Drawing Sheets

CONTOURED SUPPORT DEVICE FOR POSING INFANTS

BACKGROUND INFORMATION

1. Field of the Invention

The invention relates to the field of infant supports. More particularly, the invention relates to a support device to pose an infant for a photograph.

2. Discussion of the Prior Art

It is a common desire of parents to want to have photographs taken of their newborn child. Many parents take snapshots of the infant, of course, but many also have photographs taken by a photographer. Ideally, the photo is just of the newborn, but, because of the inability of a newborn to hold a particular position, a parent frequently holds the child. This has the disadvantage that the parent is also in the photograph.

In order to get a photograph of a newborn by itself, some means of supporting the infant in a particular position is needed. The professional photographer resorts to various measures to support an infant in a desired position. Typically, the infant is placed on a flat surface and then pillows, blankets, or other forms of padding are placed around and under the infant to support it in a particular position. This make-shift approach is often not very pleasing aesthetically and not very effective. Pillows and cushions filled with foam are compressible and the infant sinks down into them. Rolled up or folded blankets are unsightly and tend to shift if the infant moves.

One effort to solve the problem of posing an infant for a photograph is a Posing Beanbag sold by shootbaby.com. This device is an ottoman, i.e., a cushion with a relatively stiff and flat upper surface on which the infant is placed. But, with this device, too, creative efforts in adding padding to the ottoman are undertaken to obtain the desired position. In one example, padding, such as rolled up blankets, is placed on the ottoman and then a covering of some decorative fabric placed over it, to provide the necessary support to hold the infant in the desired position and also to provide an aesthetically pleasing background.

It takes time to create the proper support for the infant. This fussing with padding can be tedious and frustrating work, and moving and wedging padding under a sleeping newborn to bring it into position may also wake the infant, which can be distressing to infant and parent.

What is needed, therefore, is a support device that will allow a photographer to place an infant, including a newborn infant, into various poses. What is further needed is such a device that is a comfortable support for the infant and also aesthetically pleasing.

BRIEF SUMMARY OF THE INVENTION

The invention is a contoured support device for supporting or bolstering an infant. The inventor envisions the use of the support device as a support for infants, particularly newborn or very young infants, in order to pose an infant in a particular position for a photograph. The various aspects of the support device according to the invention will be described with reference to photography and posing, but it is understood that the support device may also be used for other purposes.

The support device has two convex curved bolster-like supports separated by a concave curve. In other words, the contoured surface of the support device has a first bolster that extends along one upper edge of the device and a second bolster that extends parallel to the first one along an opposite upper edge of the device. The height of the second bolster may be greater than that of the first one. The support device according to the invention may be constructed to various dimensions, but ideally is large enough so that it can be placed on a floor, yet provide a working surface that is high enough to allow the photographer to work with the infant with ease.

The support device has a fabric structure and a filling that is cushioning, yet non-compressible under the weight of a child. The fabric structure is constructed of a rugged material. The upper portion of the fabric structure is of a fabric that is pleasing to the touch; the lower portion, which is intended to be placed on a floor, may be constructed of the same fabric or of a more rugged fabric. Given that the device is intended to be used with infants, the fabric structure is preferably made of a material that is washable. The filling may be any suitable filling, but is ideally one that provides a cushioning support without sinking in under the weight of the infant. A very suitable filling is the conventional packing peanut or packing noodle. These packing peanuts are typically made of a polystyrene foam, thus, they are very lightweight. A further advantage of packing peanuts over other types of filler is that they have a shape that tends to interlock with adjacent peanuts, so, once they are pressed together, they hold their position when force is applied, rather than shifting under the force, as happens when pellets or beads are used that can freely slide over one another. The combination of the fabric structure and the polystyrene filling provides a comfortable support for an infant, yet a firm support that retains its shape under the weight of the child.

A relatively stiff foam, such as memory foam or other types of foam that are conventionally used in mattresses, may also be used, because this type of foam has sufficient stiffness so that it doesn't sink in significantly under the weight of an infant. Foam, however, is relatively heavy and expensive, compared to packing peanuts and beanbag filler.

The support device is not limited to a particular size. Various sizes of the support device are practical, depending on the intended use. A studio size is a large support device that is intended for use in a studio environment. A portable size with a carrying strap is dimensioned for easy carrying, stowing and transporting in a standard automobile. A jumbo size may be useful for holding twins, triplets, etc.

BRIEF DESCRIPTION OF THE DRAWINGS

The present invention is described with reference to the accompanying drawings. In the drawings, like reference numbers indicate identical or functionally similar elements.

DETAILED DESCRIPTION OF THE INVENTION

Figure 1:
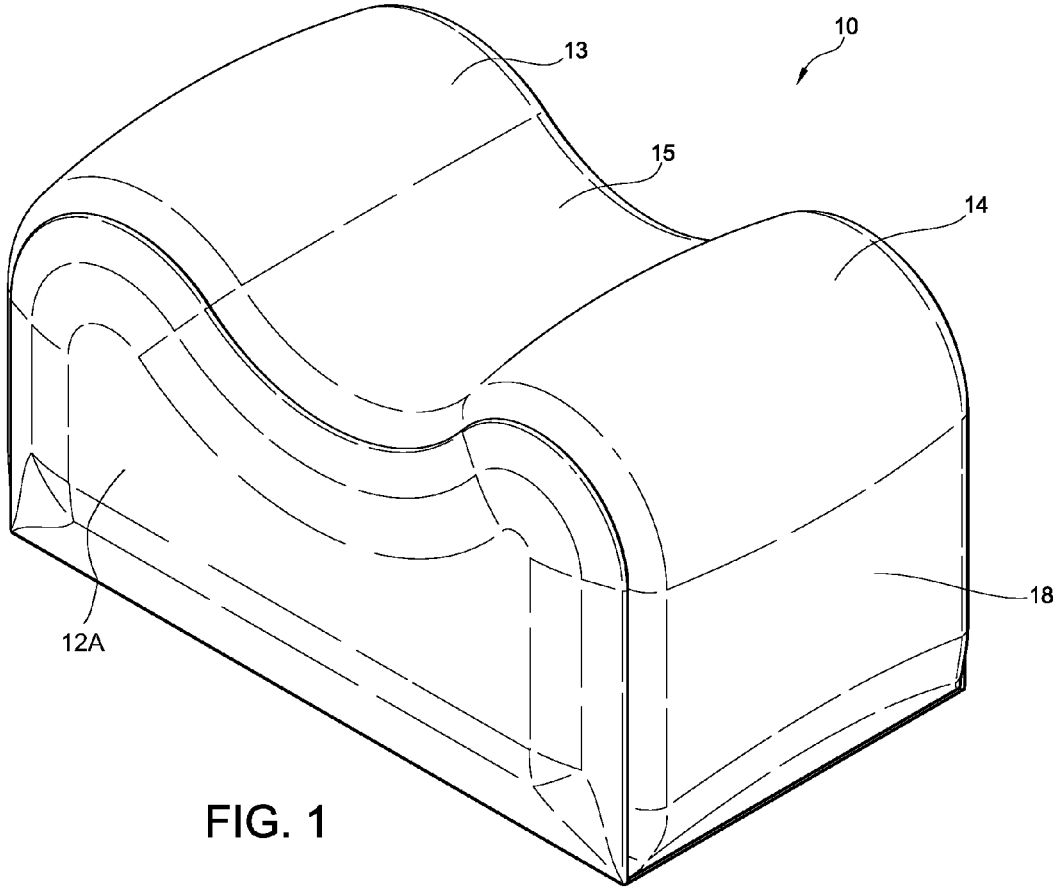
FIG. 1 is an isometric view of the support device according to the invention.
Figure 2:
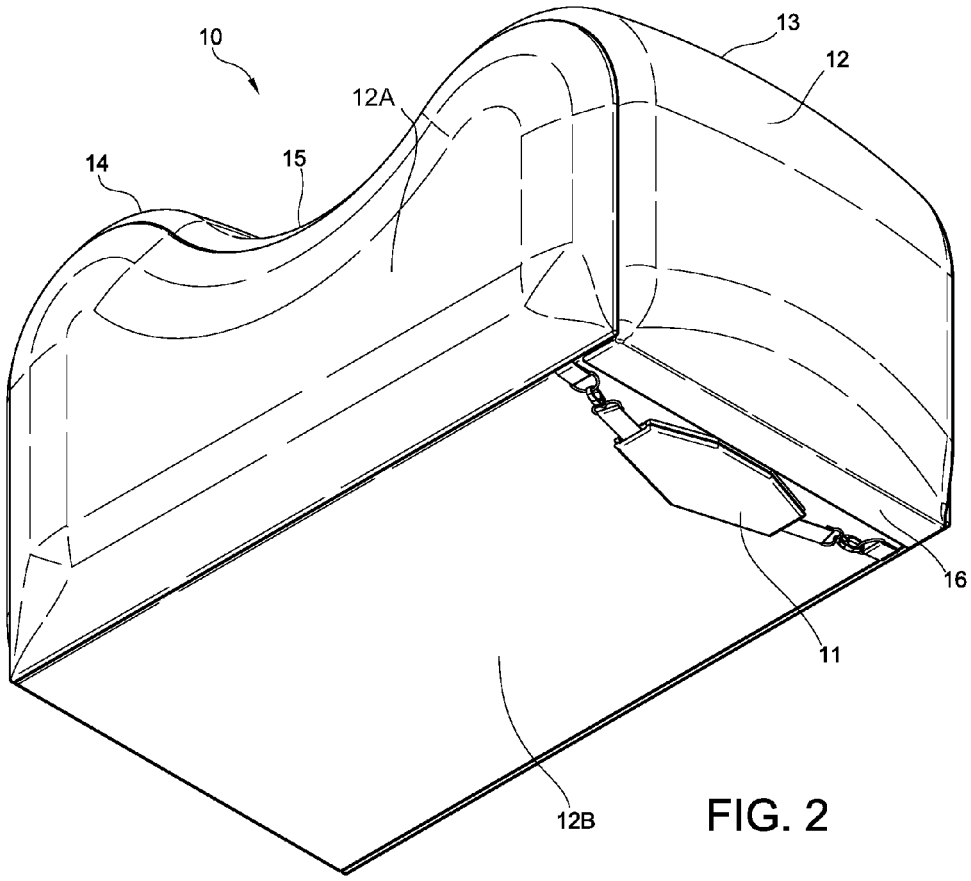
FIG. 2 is an isometric view, showing the underside of the support device.
Figure 3:
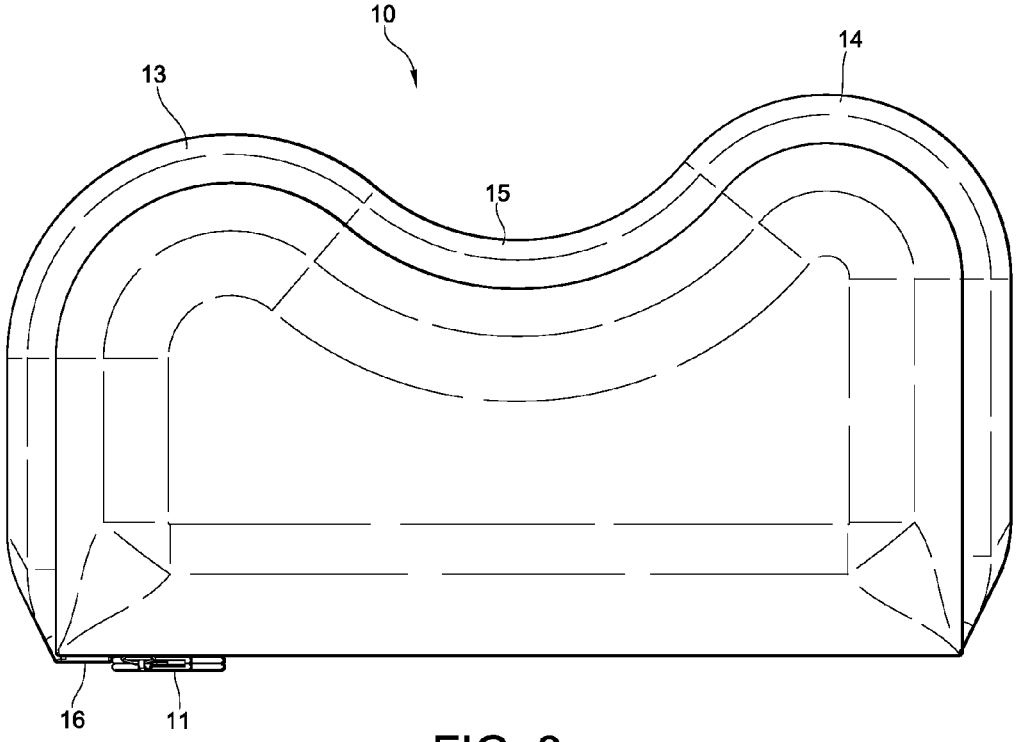
FIG. 3 is a side plan view of the support device.
Figure 4:
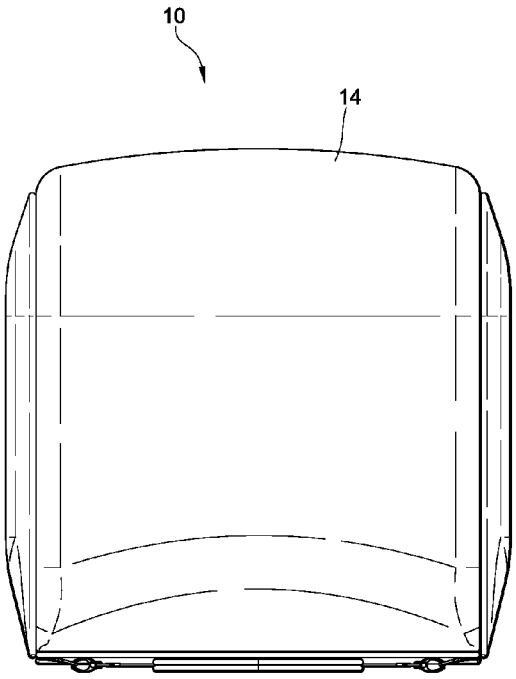
FIG. 4 is a rear plan view of the support device.
Figure 5:
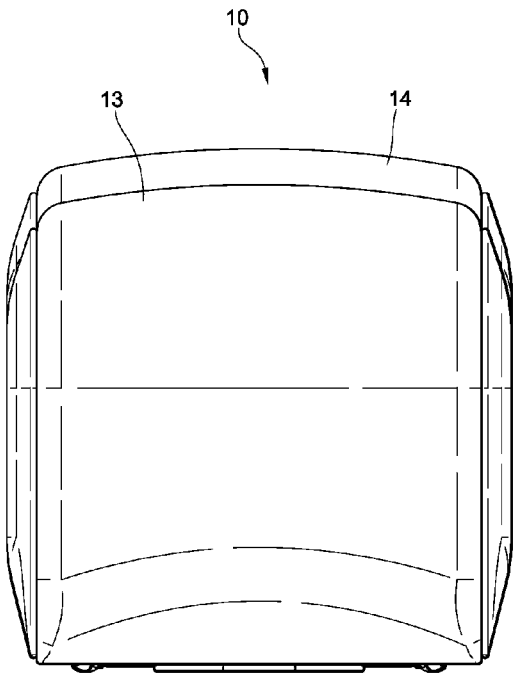
FIG. 5 is a front plan view of the support device.
Figure 6:
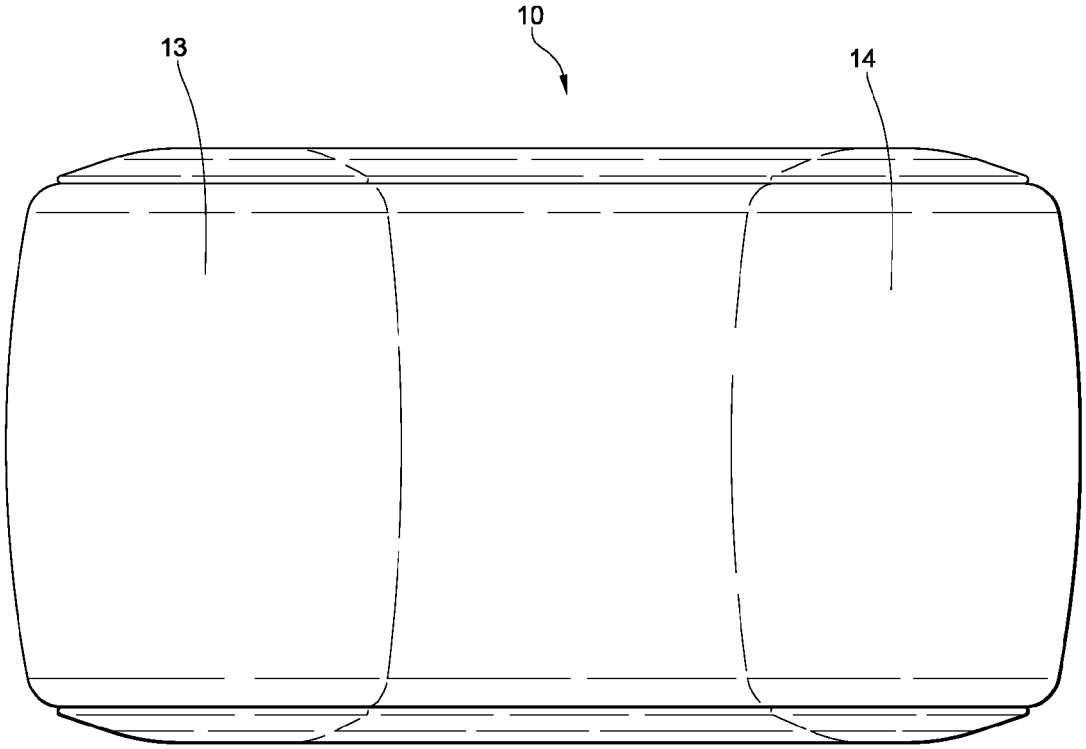
FIG. 6 is a top plan view of the support device.
Figure 7:
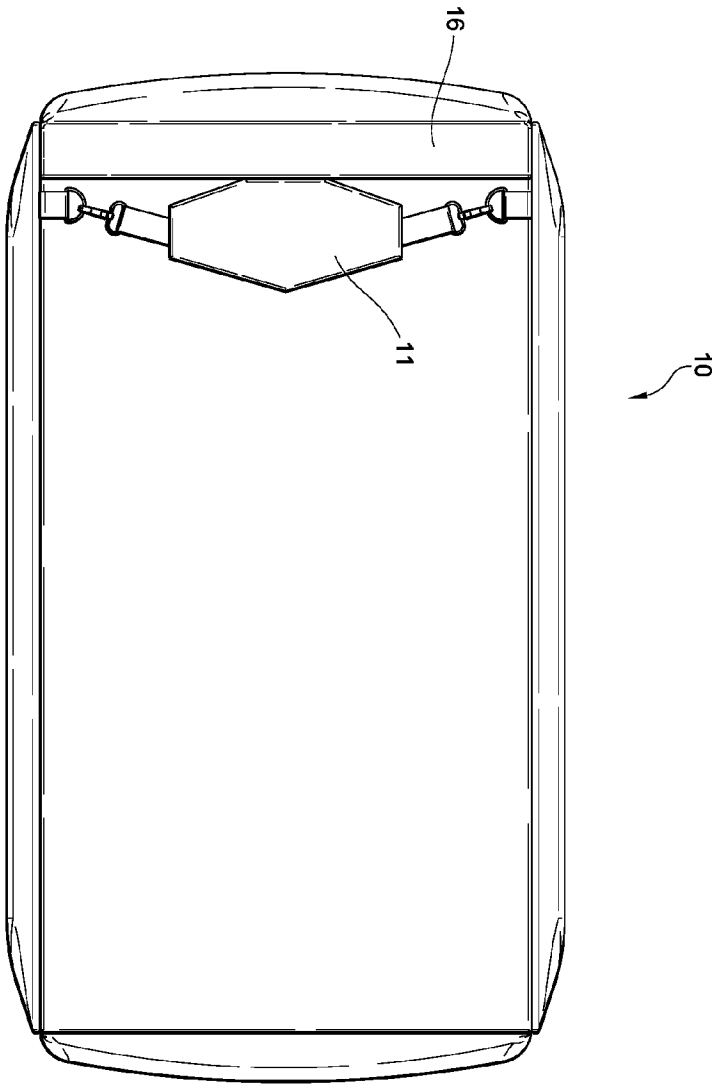
FIG. 7 is a bottom plan view of the support device.

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

FIGS. 1-7 illustrates various views of a support device 10 according to the invention, for supporting an infant. FIGS. 8-12 illustrate various positions of an infant on the support device 10 that are easily achieved, without having to use additional padding and wedging materials.

The support device 10 comprises a fabric structure or case 12 and filling 18. The fabric structure 12 has a contoured shape that includes a first bolster 13, a second bolster 14, and a valley 15 therebetween. The fabric structure 12 has an upper structure 12A and a lower structure 12B, wherein they may be constructed of two different fabrics. The upper structure 12A is preferably constructed of a washable and water-resistant fabric, such as a vinyl product that is generally known as "faux leather," and the lower structure 12B of a particularly rugged fabric that is resistant to wear. An opening 16 is provided in the fabric structure 12, to allow the fabric structure to be filled with the filling 18. A carrying strap 11 may be fastened to the fabric structure 12 to facilitate carrying the support device 10.

Many types of fill material are known, but many of them shift or compress under a load, rather than supporting the load. Examples of such fillers are expanded polystyrene EPS beads that are used in bean bags, organic materials that are typically used in pillows, such as millet hulls, or the foam or down that is typically used in head pillows or mattresses. The EPS pellets roll out from under a load, until they are forced into a space and can no longer move around. When a person sits on a bean bag, the pellets push out to the side, making a depression that envelops a portion of the person's torso. Foam compresses under the load, also creating a depression that envelops a portion of the body. Millet hulls and other particulate organic fillers either shift or compress under load.

As described above, the material recommended for the filling 18 is a packing peanut made of an expanded polystyrene foam. This type of foam is extraordinarily light and capable of supporting many times its own weight without compressing. The shape of packing peanuts makes them particularly suitable for packing around heavy items, because they don't shift out from under a heavy load, as do other materials. Common shapes of the conventional packing peanut include an S, a FIG. 8, or a W. These shapes promote an interlocking of adjacent peanuts when they are pressed together. It is this characteristic that is particularly advantageous for the filling 18. The support device 10 with a filling 18 of packing peanuts provides a firm support that does not shift or create a depression, i.e., the infant doesn't sink into the support device, yet the support does not feel hard or rigid.

Figure 8:
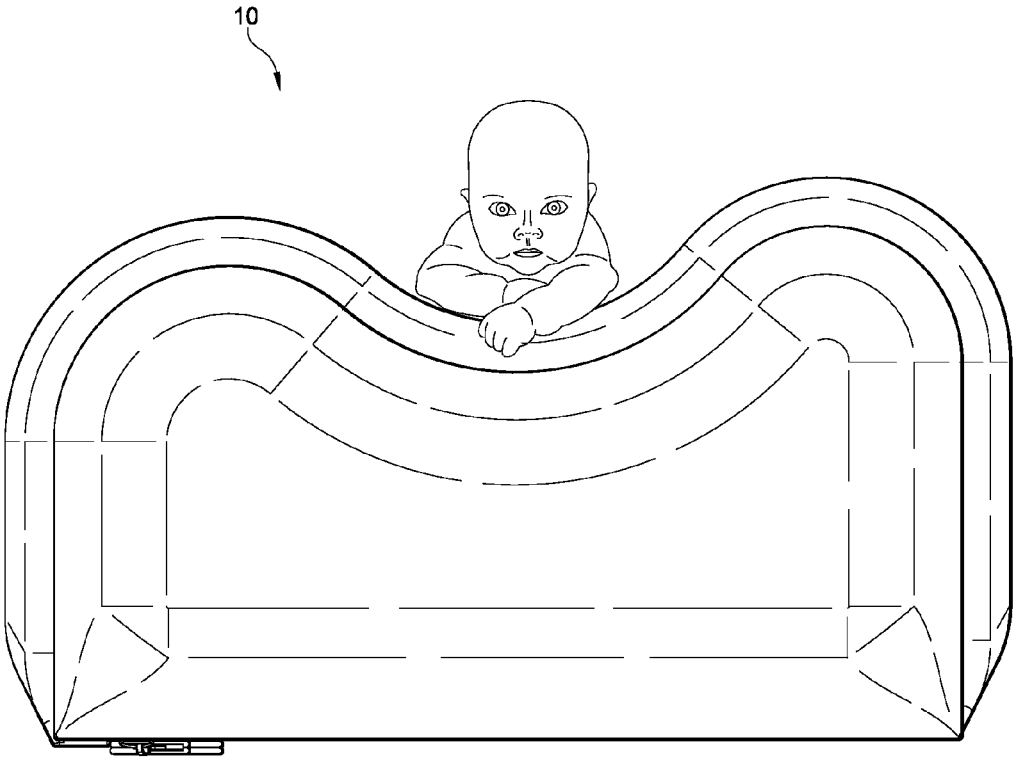
FIG. 8 illustrates an infant placed in the valley in a prone position.
Figure 9:
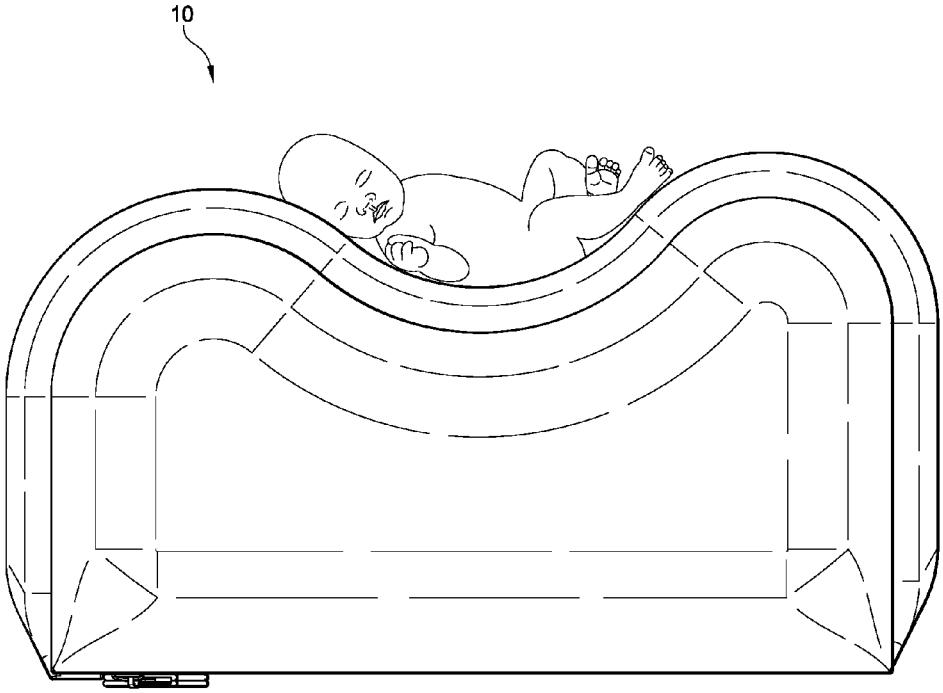
FIG. 9 illustrates an infant supported in the valley of the support device in a supine position.
Figure 10:
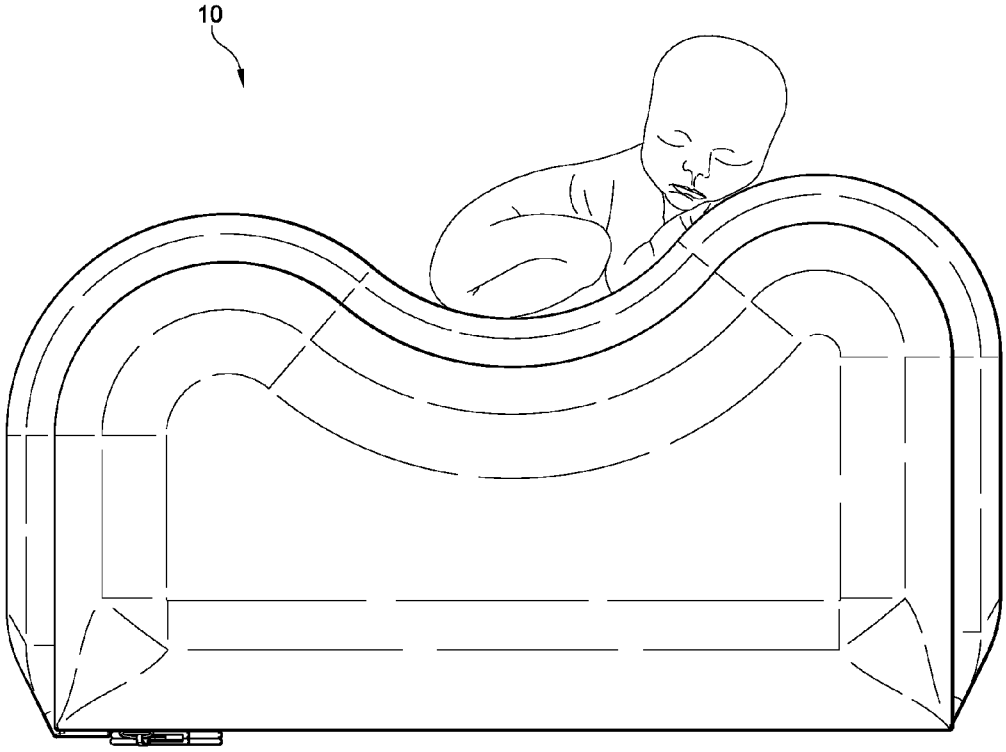
FIG. 10 illustrates a first pose of an infant supported on the front bolster.
Figure 11:
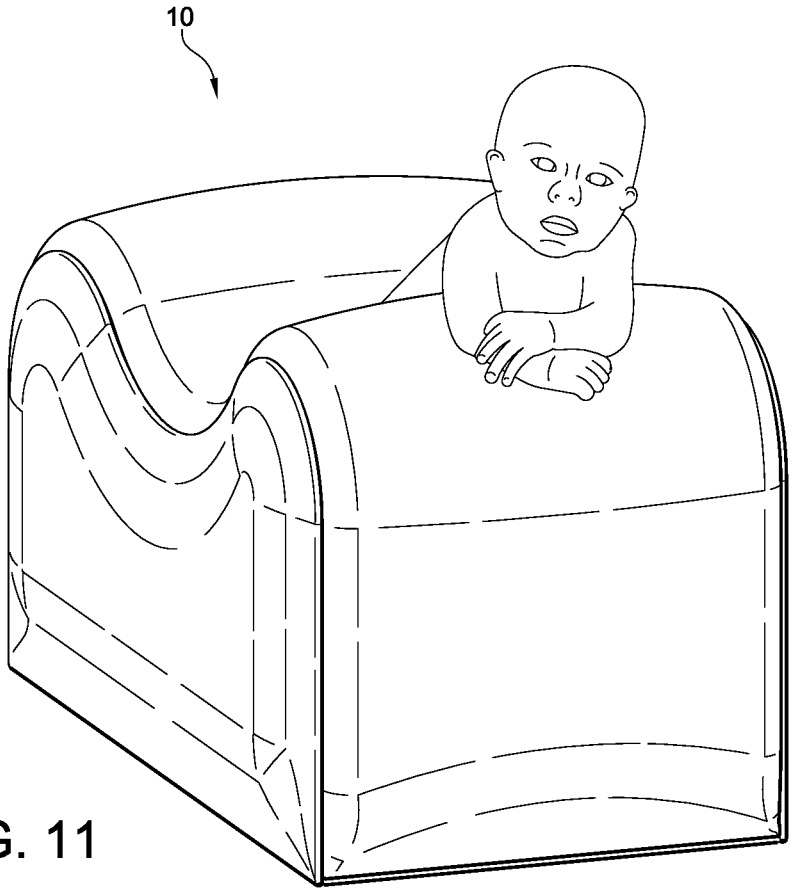
FIG. 11 illustrates a second pose an infant supported on the front bolster.
Figure 12:
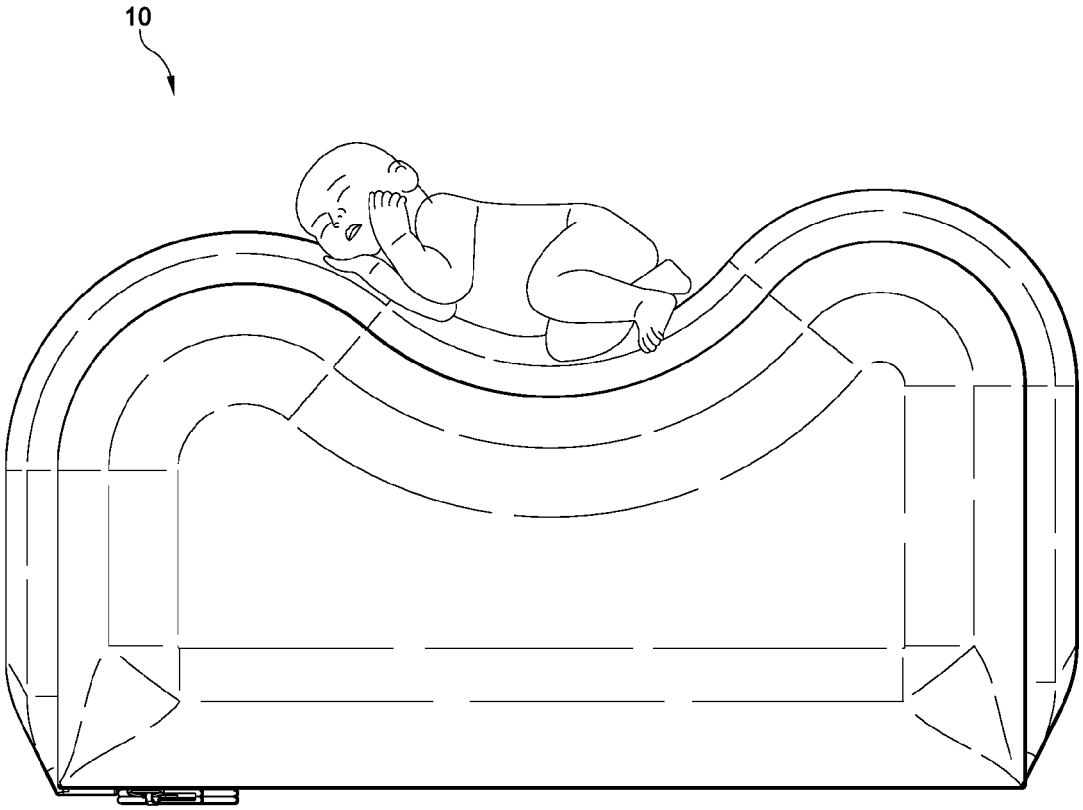
FIG. 12 illustrates an infant sleeping on her side.

FIGS. 8-12 illustrate various poses for newborns and infants that are readily achievable with the support device according to the invention. FIG. 8 illustrates an infant lying prone, placed in the valley 15 across the width of the support device; FIG. 9 an infant nestled in the valley 15, in a supine position; FIG. 10 a sleeping infant supported on the front bolster 13 15; FIG. 11 an infant propped up on the front bolster 13; and FIG. 12 an infant lying in the valley 15 and against the front bolster 13.

For transportation purposes, the fabric structure 12 may be sold and shipped separately from the filling 18. Packing peanuts are commercially available as a bulk product, so that the purchaser of the fabric structure 12 can acquire the filling 18 from a separate source. This is advantageous, because separate shipping of the filling 18 and the fabric structure 12 significantly reduces shipping costs.

As with any product used to support an infant, prudence and common sense are required. The support device 10 according to the invention is intended for use as a support for posing a baby for a photograph, i.e., in a situation in which the infant is under the watchful supervision of an adult. The support device 10 is not intended as a bed or sleeping accommodation for infants.

It is understood that the embodiments described herein are merely illustrative of the present invention. Variations in the construction of the support device may be contemplated by one skilled in the art without limiting the intended scope of the invention herein disclosed and as defined by the following claims.

What is claimed is:

1. A fabric structure for a support device for an infant, the fabric structure comprising:

a filling comprising polystyrene foam packing peanuts having an interlocking shape; and a fabric case that is fillable with the filling, the fabric case having a bottom portion and an upper portion that includes a front surface, a rear surface, side surfaces, and an upper contoured surface that includes a first convex bolster contour that extends along an upper edge of the front surface, a second convex bolster contour that extends along an upper edge of the rear surface, and a valley contour therebetween, the first convex bolster contour and the second convex bolster contour having approximately the same size and shape, and further including an opening for introducing the filling into the case wherein the interlocking shape of the packing peanuts prevents the filling from shifting out from under a weight that is applied thereto.

2. A support device for supporting an infant, the support device comprising:

a fabric structure that includes a fabric case having a bottom portion and an upper portion that includes a front surface, a rear surface, side surfaces, and an upper contoured surface that includes, a first convex bolster contour that extends along an upper edge of the front surface, a second convex bolster contour that extends along an upper edge of the rear surface, and a valley contour there between, the first convex bolster contour and the second convex bolster contour having approximately the same size and shape; and a filling for filling out the fabric structure, thereby providing a support surface with the first convex bolster contour, the second convex bolster contour, and the valley there between, the filling comprising polystyrene foam packing peanuts that have an interlocking shape, thereby preventing the packing peanuts from shifting out from under a weight applied thereto; wherein the fabric structure has an opening for introducing the filling into the fabric case.

3. A kit for a support device for an infant, the kit comprising:

a filling comprising polystyrene foam packing peanuts having an interlocking shape; and a fabric case that is fillable with the filling, the fabric case having a bottom portion and an upper portion that includes a front surface, a rear surface, side surfaces, and an upper contoured surface that includes a first convex bolster contour that extends along an upper edge of the front surface, a second convex bolster contour that extends along an upper edge of the rear surface, and a valley contour there between, the first convex bolster contour and the second convex bolster contour having approximately the same size and shape, and further including an opening for introducing the filling into the case; wherein, when filled into the fabric case, the interlocking shape of the packing peanuts prevents the filling from shifting out from under a weight that is applied thereto; and wherein the filling and the fabric case are separately shippable.

* * * * *